United States Patent [19]

Weber

[11] 4,327,305

[45] Apr. 27, 1982

[54] ROTATABLE X-RAY TARGET HAVING OFF-FOCAL TRACK COATING

[75] Inventor: Richard G. Weber, Stamford, Conn.

[73] Assignee: The Machlett Laboratories, Inc., Stamford, Conn.

[21] Appl. No.: 121,859

[22] Filed: Feb. 15, 1980

Related U.S. Application Data

[63] Continuation of Ser. No. 962,445, Nov. 20, 1978.

[51] Int. Cl.[3] ..... H01J 35/08

[52] U.S. Cl. ..... 313/330; 313/311; 313/55; 427/65

[58] Field of Search ..... 313/311, 330, 55, 60; 427/65, 160

[56] References Cited

U.S. PATENT DOCUMENTS

| | | | |
|---|---|---|---|
| 3,710,162 | 1/1973 | Bougle | 313/330 |
| 3,801,847 | 4/1974 | Dietz | 313/330 |
| 3,851,204 | 11/1974 | Rollfinke | 313/330 |
| 3,919,124 | 11/1975 | Friedel et al. | 313/330 |
| 3,993,923 | 11/1976 | Magendans et al. | 313/311 |
| 4,029,828 | 6/1977 | Bildstein et al. | 313/330 |

*Primary Examiner*—Saxfield Chatmon, Jr.

*Attorney, Agent, or Firm*—John T. Meaney; Joseph D. Pannone

[57] ABSTRACT

An X-ray tube including a tubular envelope having therein an anode target provided with a surface portion made of X-ray emissive material and with another surface portion made of heat emissive material comprising at least one of the members from the group consisting of hafnium boride, hafnium oxide, hafnium nitride, hafnium silicide, and hafnium aluminide; and an electron emitting cathode disposed to direct a beam of electrons onto the anode surface portion made of X-ray emissive material.

10 Claims, 3 Drawing Figures

ROTATABLE X-RAY TARGET HAVING OFF-FOCAL TRACK COATING

CROSS-REFERENCE TO RELATED CASES

This is a continuation of application Ser. No. 962,445, filed Nov. 20, 1978.

BACKGROUND OF THE INVENTION

1. Field of the Invention

This invention relates generally to X-ray tubes and is concerned more particularly with a rotatable X-ray target having improved heat emissive surface means.

2. Discussion of the Prior Art

Generally, an X-ray tube of the rotating anode type includes an evacuated envelope having therein an electron emitting cathode disposed to beam high energy electrons onto an aligned focal spot area of a spaced anode target. The target may comprise a rotatable disc having adjacent its outer periphery an annular focal track made of X-ray emissive material, such as tungsten-rhenium alloy, for example. Thus, electrons beamed from the cathode may be focused onto a focal spot surface area of the focal track to penetrate into the underlying material and generate X-rays which radiate therefrom and out of the tube.

Most of the electron energy incident on the focal spot area of the focal track is converted to heat energy which could become excessive and damage the surface of the focal track. Consequently, the target disc usually is mounted for axial rotation by having a central portion thereof attached to a stem end portion of a magnetic induction rotor which is supported by bearings in the envelope. Thus, an external stator encircling the rotor may be adjustably energized for rotating the rotor and attached disc to move successive radial segments of the focal track at a desired speed through the focal spot area aligned with the electron beam. As a result, heat energy is accumulated in the body of the target and must be dissipated therefrom before becoming sufficiently excessive to cause warping or cracking of the disc.

However, the stem end portion of the rotor generally is provided with a suitable cross-sectional configuration for restricting the flow of heat from the attached disc to the rotor in order to prevent damage to the support bearings thereof. Therefore, the heat energy accumulated in the target disc cannot be dissipated efficiently by conduction through adjacent structure, and cannot be dissipated by convection since the tube envelope is evacuated. Consequently, the accumulated heat energy in the target disc is dissipated predominantly by radiation to the tube envelope, which may be cooled by a dielectric fluid, such as an X-ray transparent oil, for example.

Thus, it is advantageous and desirable to provide an X-ray tube with a target having improved heat emissive surface means for dissipating heat from the target.

SUMMARY OF THE INVENTION

Accordingly, this invention provides an X-ray tube including an evacuated envelope having therein an anode target provided with a surface portion made of X-ray emissive material and another surface portion made of heat emissive material comprising at least one of the members of the group consisting of hafnium boride, hafnium oxide, hafnium nitride, hafnium silicide, and hafnium aluminide. An electron emitting cathode is disposed within the envelope and spaced from the target body to direct a beam of high energy electrons onto a focal spot area of the surface portion made of X-ray emissive material.

Thus, the target body may be made of a preferred material having a surface portion thereof coated with X-ray emissive material and having another surface portion thereof coated with the heat emissive material. As a first alternataive, the target body may be made of X-ray emissive material and have a surface portion outside of the focal spot area coated with the heat emissive material. As a second alternataive, the target body may be made of the heat emissive material and have a focal spot surface portion thereof coated with X-ray emissive material.

A preferred embodiment comprises an X-ray tube including a tubular envelope having rotatably mounted therein an anode target disc made of suitable lightweight material, such as molybdenum-tungsten alloy, for example. Disposed on the disc and adjacent the outer periphery thereof is an annular focal track layer of efficient X-ray emissive material, such as tungsten-rhenium alloy, for example. The X-ray emissive material of the focal track layer is mechanically and thermally coupled to the material of the substrate disc by suitable means, such as chemical vapor deposition, for example. Disposed on portions of the disc outside of the focal track is a heat emissive coating of hafnium oxide material, which preferably has a thickness in the range of one half a thousand to four thousands of an inch. The hafnium oxide material is mechanically and thermally coupled to the material of the substrate disc by suitable means, such as plasma spraying, sputtering, evaporation, or chemical vapor deposition, for example.

BRIEF DESCRIPTION OF THE DRAWINGS

For a better understanding of this invention, reference is made in the following, more detailed description to the drawings wherein.

DESCRIPTION OF THE PREFERRED EMBODIMENT

Figure 1:
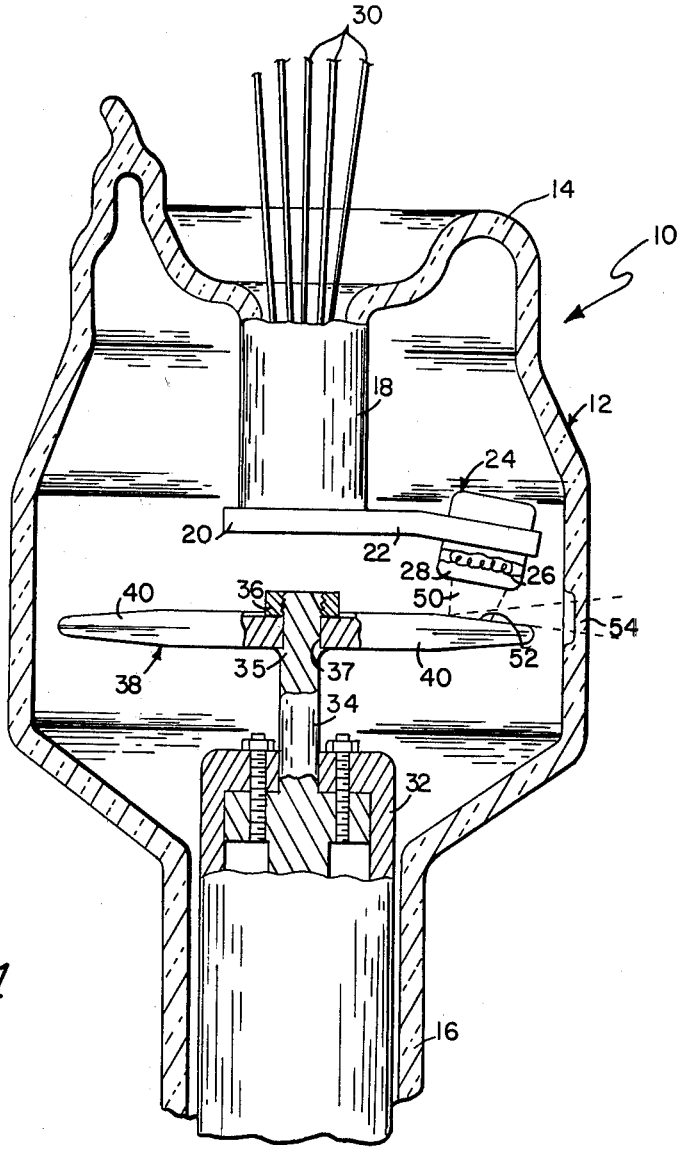
FIG. 1 is a fragmentary axial view, partly in section, of an X-ray tube embodying the invention.

Referring to the drawing wherein like characters of reference designate like parts, there is shown in FIG. 1 an X-ray tube 10 of the rotating anode type having a tubular envelope 12 made of dielectric material, such as glass, for example. Envelope 12 is provided with a reentrant end portion 14 and an opposing neck portion 16. The reentrant end portion of envelope 12 is peripherally sealed to one end of a cathode support sleeve 18 made of rigid material, such as Kovar, for example. Cathode sleeve 18 extends axially within the envelope 12 and has an inner end sealed to a cap 20 which supports a radially extending, hollow arm 22.

The arm 22 is angulated with respect to the axis of cathode sleeve 18 and supports on a distal end portion thereof a conventional cathode head 24. Cathode head 24 generally includes an electron emitting filament 26 which is longitudinally disposed within a grid-type focusing cup 28. Electrical conductors 30 extend hermetically through the envelope and insulatingly through the hollow arm 22 for suitable connection to the filament 26 and the focusing cup 28 in a well-known manner.

Sealed within the neck portion 16 of envelope 12 is a bearing mounted rotor 32 of a magnetic-type induction motor, (the external stator of which is not shown). The rotor 32 extends exially within envelope 12 and has attached to its inner end an axially extending stem 34. Stem 34 may be provided with an annular shoulder 35 for supporting a transversely disposed anode target 38 having a central aperture 37 through which a threaded end portion of the stem 34 protrudes. The target 38 is fixedly attached to the stem 34, as by a hex nut 36 engaging the threaded end portion of stem 34, for example, and is rotated by the rotor 32 in a well-known manner.

Figure 2:
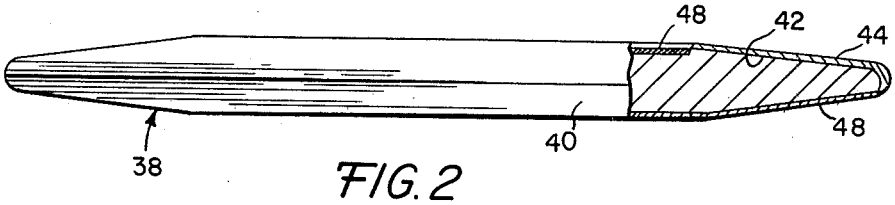
FIG. 2 is an enlarged elevational view, partly in section, of one embodiment of the X-ray target of this invention.

As shown in FIG. 2, the anode target 38 may comprise a substrate disc 40 made of suitable lightweight material, such as molybdenum-tungsten alloy, for example. The disc 40 has a surface disposed in spaced opposing relationship with cathode 24 and provided with an an annular marginal portion 42 which is inclined radially toward the adjacent outer periphery of the disc. Disposed on the sloped surface portion 42 of disc 40 is an annular focal track 44 comprising a layer of efficient X-ray emissive material, such as tungsten-rhenium alloy, for example. The X-ray emissive material of the focal track 44 is mechanically and thermally coupled to the material of substrate disc 40 by suitable means, such as chemical vapor deposition, for example.

Surface portions of disc 40 outside of the focal track 44 are provided with a heat emissive coating 48 made of at least one of the members of the group consisting of hafnium boride, hafnium oxide, hafnium nitride, hafnium silicide, and hafnium aluminide. Thus, outside of the focal track 44, the anode target 38 is provided with surface portions made of material having greater emissivity than the sintered tungsten material which may be used for heat emissive coatings on X-ray targets of the prior art. The members of the specified group also have respective melting points greater than two thousand degrees Centigrade, and have respective vapor pressures less than one millionth of a Torr at eighteen hundred degrees Centigrade. Furthermore, the members of the specified group do not react with other materials used in the fabrication of conventional X-ray tubes and, therefore, do not degrade tube stability.

Accordingly, the emissive coating may be made of hafnium oxide, for example, which has excellent adherence to the molybdenum material of the substrate disc 40. The material of heat emissive coating 48 is mechanically and thermally coupled to the material of disc 40 by suitable means, such as are plasma spraying, sputtering, evaporation, chemical vapor deposition, or spraying with a binder followed by high temperature sintering, for example. Subsequently, loose particles may be removed from the heat emissive coating 48 by subjecting the coating surface to a suitable process, such as polishing or grid blasting, for examples. Preferably, the heat emissive coating 48 is provided with a thickness between one-half a thousandth and four thousandths of an inch.

In operation, electrical energy supplied through the conductors 30 heats the filament 26 of cathode 24 to an electron emitting temperature, and maintains the focusing cup 28 at a suitable electrical potential for directing the emitted electrons into a beam 50 which impinges on an aligned focal spot area 52 of the focal track 44. The focal spot area 52 may be of conventional size, such as one millimeter wide by five millimeters extended radially along the slope of the focal track, for example. Also, the anode target 38 is maintained at a sufficiently high electrical potential, such as eighty thousand volts, for example, with respect to the cathode filament 26 to accelerate electrons in the beam 50 to high kinetic energy levels. As a result, the electrons impinging on the focal spot surface area 52 of focal track layer 44 penetrate into the underlying X-ray emissive material to generate X-rays. Thus, X-rays radiating from the focal spot area 52 pass in a beam (not shown) through a radially aligned, X-ray transparent window 54 in the envelope 12.

However, most of the electron energy incident on the focal spot area 52 is converted into heat within the underlying material of focal track 44. Consequently, the target disc 40 is rotated at an appropriately high angular velocity, such as ten thousand revolutions per minute, for example, to move successive segments of the annular focal track 44 rapidly through the focal spot area 52. The resulting heat developed in respective segments of focal track 44, while in the focal spot area 52, is conducted to relatively cooler portions of the target disc 40 outside of the focal track. In this manner, the segments of focal track 44, when rotated out of the focal spot area 52, may have their respective temperatures reduced to relatively safe values for re-entering the focal spot area.

Thus, heat is accumulated in the body of target disc 40 for dissipation through surrounding tube structure before becoming sufficiently excessive to cause damage, such as warping or cracking of the target disc, for example. However, envelope 12 is evacuated, and the stem 32 generally is provided with a minimum cross-sectional area to restrict the flow of heat to rotor 32 in order to avoid damaging the support bearings thereof. Accordingly, the heat accumulated in the body of target disc 40 is dissipated predominantly by radiation to the envelope 12 which may be cooled by immersion in a dielectric fluid (not shown), such as an X-ray transparent oil, for example. As a result, the emissivity capability of target disc 40 is a limiting factor in determining the maximum amount of electron energy that can be incident on the focal spot area 52 and, consequently, the maximum X-ray intensity that can be obtained from the tube.

Therefore, in accordance with this invention, surface portions of the target disc 40 outside of the focal track 44 are mechanically and thermally coupled to the hafnium oxide material of heat emissive coating 48. Hafnium oxide, which has an emissivity of about six-tenths, is approximately thirty-five percent more effective in dissipating heat than the conventional sintered tungsten material, which has an emissivity of about three-tenths. In comparison tests of a first group of X-ray tubes having target discs provided with heat emissive coatings of hafnium oxide and a second group of X-ray tubes having target discs provided with heat emissive coatings of sintered tungsten material, the target discs of the first group had focal tracks which operated about ninety to one hundred degrees centigrade cooler than target disc focal tracks of the second group. Also, in order to bring target disc focal tracks of the first group up to the operating temperatures of the target disc focal tracks of the second group, the input power to the tubes of the first group required about a twenty percent increase. Thus, the X-ray tubes having target discs provided with heat emissive coatings of hafnium oxide may be operated at lower focal track temperatures or at higher input power levels, as compared to the X-ray tubes having target discs provided with heat emissive coatings of conventional sintered tungsten material.

Figure 3:
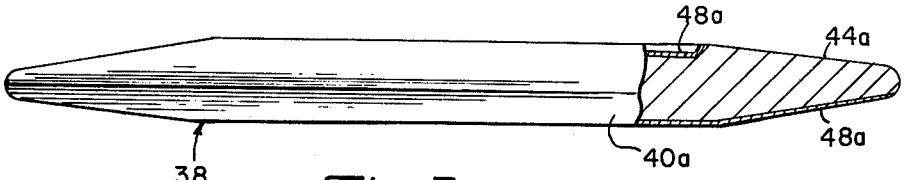
FIG. 3 is an enlarged elevational view, partly in section, of an alternative embodiment of the X-ray target of this invention.

As shown in FIG. 3, the X-ray target 38 alternatively may comprise an axially rotatable disc 40*a* made of efficient X-ray emissive material, such as tungsten-rhenium alloy, for example. The disc 40*a* may have adjacent its outer periphery an annular focal track 44*a* comprising an uncoated disc portion which is sloped radially toward the outer periphery of the disc and disposed in spaced opposing relationship with the cathode 24. The surface portions of disc 40*a* outside of the focal track 44*a* are provided with a heat emissive coating 48*a* of hafnium oxide material, which is mechanically and thermally coupled to the material of the disc 40*a*.

As another alternative, the X-ray target 38 may include an axially rotatable disc (not shown) made of heat emissive material comprising at least one of the members of the specified group, and have adjacent its outer periphery an annular focal track layer made of X-ray emissive material, such as shown in FIG. 2, for example. Also, although the X-ray target 38 has been shown herein as a generally flat disc, it may equally well have other configurations, such as cup-shaped, for example. Furthermore, although the emissive coating is shown on both extended surfaces of the target disc, it may be provided on only one surface portion of the substrate disc.

From the foregoing it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described is to be interpreted as illustrative and not in a limiting sense.

What is claimed is:

1. An X-ray target of the rotatable type adapted for mounting on a rotor and including:

a body having a first surface portion made of X-ray emissive material and a second surface portion made of a heat emissive material comprised of at least ninety-five percent by weight hafnium compound, said compound being at least one of the members from the group consisting of hafnium boride, hafnium oxide, hafnium nitride, hafnium silicide, and hafnium aluminide.

2. An X-ray target as set forth in claim 1 wherein the body is a rotatable disc.

3. An X-ray target as set forth in claim 2 wherein the first surface portion is annular and disposed adjacent the outer periphery of the disc.

4. An X-ray target as set forth in claim 1 wherein the second surface portion comprises a coating mechanically and thermally coupled to body.

5. An X-ray target as set forth in claim 1 wherein the first surface portion comprises a coating mechanically and thermally coupled to the body.

6. An X-ray tube of the rotatable anode type including:

an evacuable envelope;

an anode rotor rotatably supported within said envelope;

an X-ray target mounted on said rotor in the envelope and comprising a body having a first surface portion made of X-ray emissive material and a second surface portion made of heat emissive material comprised of at least ninety-five percent by weight hafnium compound, said compound being at least one of the members of the group consisting of hafnium boride, hafnium oxide, hafnium nitride, hafnium silicide, and hafnium aluminide; and means disposed in the envelope for beaming electrons into the X-ray emissive material and generating X-rays.

7. An X-ray tube as set forth in claim 6 wherein said body of the target comprises a rotatable disc.

8. An X-ray tube as set forth in claim 7 wherein said first surface portion is annularly disposed adjacent the outer periphery of the disc.

9. An X-ray tube as set forth in claim 8 wherein the X-ray emissive material comprises a coating mechanically and thermally coupled to the disc.

10. An X-ray tube as set forth in claim 6 wherein the heat emissive material comprises a coating mechanically and thermally coupled to the disc.

* * * * *